US011196198B2

(12) United States Patent
Dong et al.

(10) Patent No.: US 11,196,198 B2
(45) Date of Patent: Dec. 7, 2021

(54) CARD EDGE CONNECTOR WITH IMPROVED CONTACTS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yuan-Yuan Dong, Kunshan (CN); Xiao-Hu Yin, Huaian (CN); Guo-Xiang Niu, Huaian (CN); Wen-Jun Tang, Kunshan (CN); Xun Wu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/864,147

(22) Filed: Apr. 30, 2020

(65) Prior Publication Data

US 2020/0350717 A1 Nov. 5, 2020

(30) Foreign Application Priority Data

May 3, 2019 (CN) ..... 201910366296.1
May 3, 2019 (CN) ..... 201920624084.4
May 22, 2019 (CN) ..... 201910426725.X

(51) Int. Cl.
*H01R 12/72* (2011.01)
*H01R 13/11* (2006.01)
(Continued)

(52) U.S. Cl.
CPC ..... *H01R 12/721* (2013.01); *H01R 13/11* (2013.01); *H01R 13/646* (2013.01); *H01R 12/737* (2013.01)

(58) Field of Classification Search
CPC .... H01R 12/721; H01R 12/737; H01R 13/11; H01R 13/646
(Continued)

(56) References Cited

U.S. PATENT DOCUMENTS 4,693,533 A * 9/1987 Szczesny ..... H01R 12/675 439/350
4,995,825 A * 2/1991 Korsunsky ..... H01R 12/7005 439/326
(Continued)

*Primary Examiner* — Peter G Leigh
(74) *Attorney, Agent, or Firm* — Ming Chieh Chang; Wei Te Chung

(57) ABSTRACT

A card edge connector includes a longitudinal insulating housing including two long walls and a bottom wall connecting with the long wall and defining a card slot in a longitudinal direction among the long walls and the bottom wall, two rows of contact arranged in the long walls respectively. Each contact includes a retaining portion, a spring portion extending from the retaining portion and leg portion extending from the retaining portion and out of the insulating housing. The spring portions define contacting portions projecting into the card slot. Each contact is formed by directly punching out from a metal plate, the retaining portions define an outer edge and inner edge interfered with the insulating housing and two opposite plane faces connecting with the outer and inner edge and disposed perpendicular to the longitudinal direction.

19 Claims, 18 Drawing Sheets

(51) Int. Cl.
*H01R 13/646* (2011.01)
*H01R 12/73* (2011.01)

(58) Field of Classification Search
USPC ..... 493/386
See application file for complete search history.

(56) References Cited

U.S. PATENT DOCUMENTS 5,035,631 A * 7/1991 Piorunneck ..... H01R 13/6582 439/108
5,425,658 A * 6/1995 White ..... H01R 12/721 439/637
5,516,304 A * 5/1996 Yu ..... H01R 12/7005 439/326
5,605,464 A * 2/1997 Ikesugi ..... G01R 1/0408 439/70
5,634,819 A * 6/1997 Pan ..... H01R 12/721 439/637
5,915,976 A * 6/1999 McHugh ..... H01R 13/6582 439/74
6,019,616 A * 2/2000 Yagi ..... H01R 13/6582 439/108
6,634,911 B1 * 10/2003 Billman ..... H01R 12/716 439/637
6,739,884 B2 * 5/2004 Vicich ..... H01R 13/658 439/108
6,929,510 B2 * 8/2005 Pan ..... H01R 13/6582 439/607.31
7,114,963 B2 * 10/2006 Shuey ..... H01R 23/6873 439/79
7,578,701 B2 * 8/2009 Hsu ..... H01R 13/6594 439/607.34
8,113,863 B2 * 2/2012 Vrenna ..... H01R 12/721 439/327
8,665,587 B2 * 3/2014 Peng ..... G06F 1/185 361/679.32
8,672,713 B2 * 3/2014 Tajiri ..... H01R 12/585 439/630
9,196,986 B2 * 11/2015 Tanaka ..... H01R 12/737
9,287,654 B2 * 3/2016 Takaki ..... H01R 13/629
9,325,090 B2 * 4/2016 Shen ..... H01R 12/721
9,570,823 B2 * 2/2017 Lai ..... H01R 12/716
9,608,349 B2 * 3/2017 Mashiyama ..... H01R 13/2457
9,780,512 B2 * 10/2017 Hsu ..... H01R 12/7005
9,941,621 B2 * 4/2018 Tang ..... H01R 12/721
9,972,945 B1 * 5/2018 Huang ..... H01R 13/6585
10,193,253 B2 * 1/2019 Li ..... H01R 12/721
10,224,653 B2 * 3/2019 Niu ..... H01R 13/645
2005/0282437 A1 * 12/2005 Fan ..... H01R 13/4538 439/607.05
2007/0123076 A1 * 5/2007 Sabo ..... H01R 12/89 439/157
2009/0209142 A1 * 8/2009 Sasaoka ..... H01R 12/716 439/862
2017/0033508 A1 * 2/2017 Hsu ..... H01R 13/629
2018/0019541 A1 * 1/2018 Cai ..... H01R 12/721
2018/0054010 A1 * 2/2018 Xu ..... H01R 12/737
2018/0097320 A1 * 4/2018 Hashiguchi ..... H01R 13/415
2019/0058292 A1 * 2/2019 Xu ..... H01R 13/6597
2019/0058293 A1 * 2/2019 Zhu ..... H01R 13/504
2019/0190212 A1 6/2019 Foxconn

* cited by examiner

CARD EDGE CONNECTOR WITH IMPROVED CONTACTS

FIELD OF THE DISCLOSURE

The invention is related to a card edge connector, and particularly to a card edge connector with improved contacts.

DESCRIPTION OF RELATED ARTS

Currently, a card edge connector is used to connect a card module card to a printed circuit board. US20190190212A1 discloses a card edge connector, which includes an elongate insulating housing, contacts retained in the housing and a ground member. The ground member is assembled in the bottom of the housing and includes a plurality of spring fingers elastically pressing against corresponding ground contacts of the contacts. The insertion of the ground member will make a task of crack of the housing.

Therefore, it is desired to provide a new card edge connector.

SUMMARY OF THE DISCLOSURE

To achieve the above desire, a card edge connector comprises a longitudinal insulating housing comprising two long walls and a bottom wall connecting with the long wall and defining a card slot in a longitudinal direction among the long walls and the bottom wall, two rows of contact arranged in the long walls respectively, each contact includes a retaining portion, a spring portion extending from the retaining portion and leg portion extending from the retaining portion and out of the insulating housing. The spring portions define contacting portions projecting into the card slot. Each contact is formed by directly punching out from a metal plate, the retaining portions define an outer edge and inner edge interfered with the insulating housing and two opposite plane faces connecting with the outer and inner edge and disposed perpendicular to the longitudinal direction.

DETAILED DESCRIPTION OF THE PREFERRED EMBODIMENT

Figure 1:
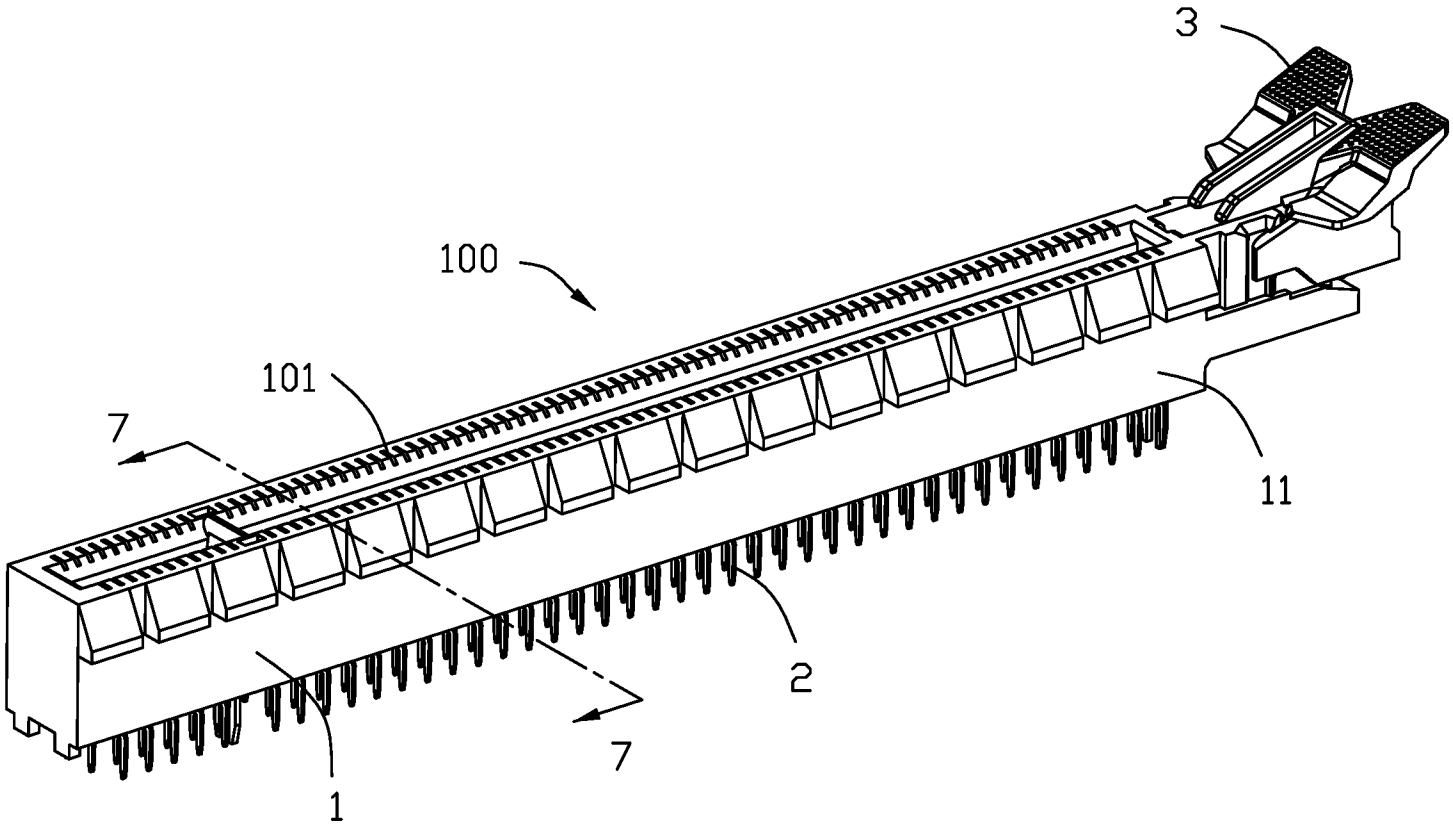
FIG. 1 is a top perspective view of a card edge connector according to a first embodiment of the present invention.
Figure 2:
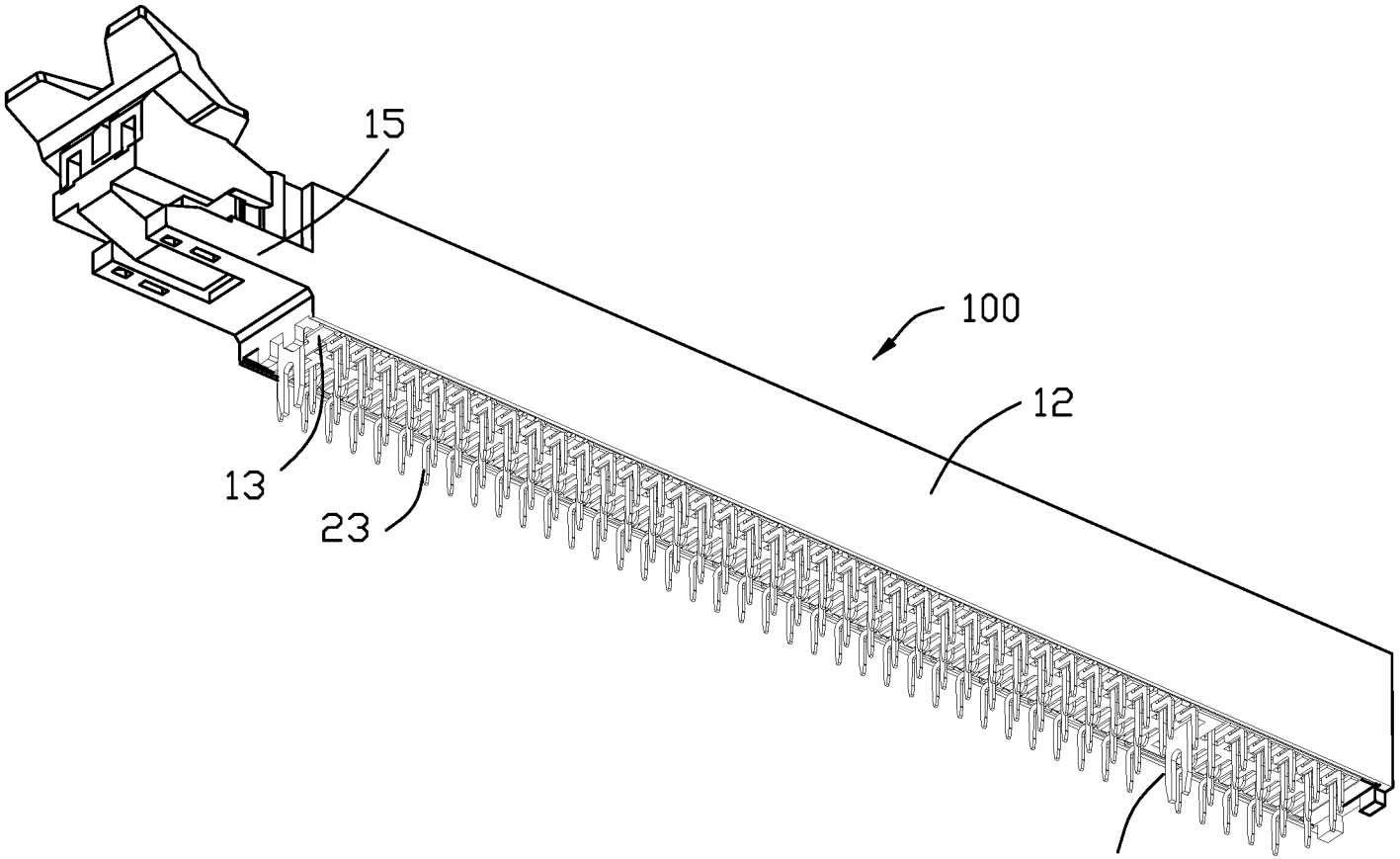
FIG. 2 is a bottom perspective view of FIG. 1.
Figure 3:
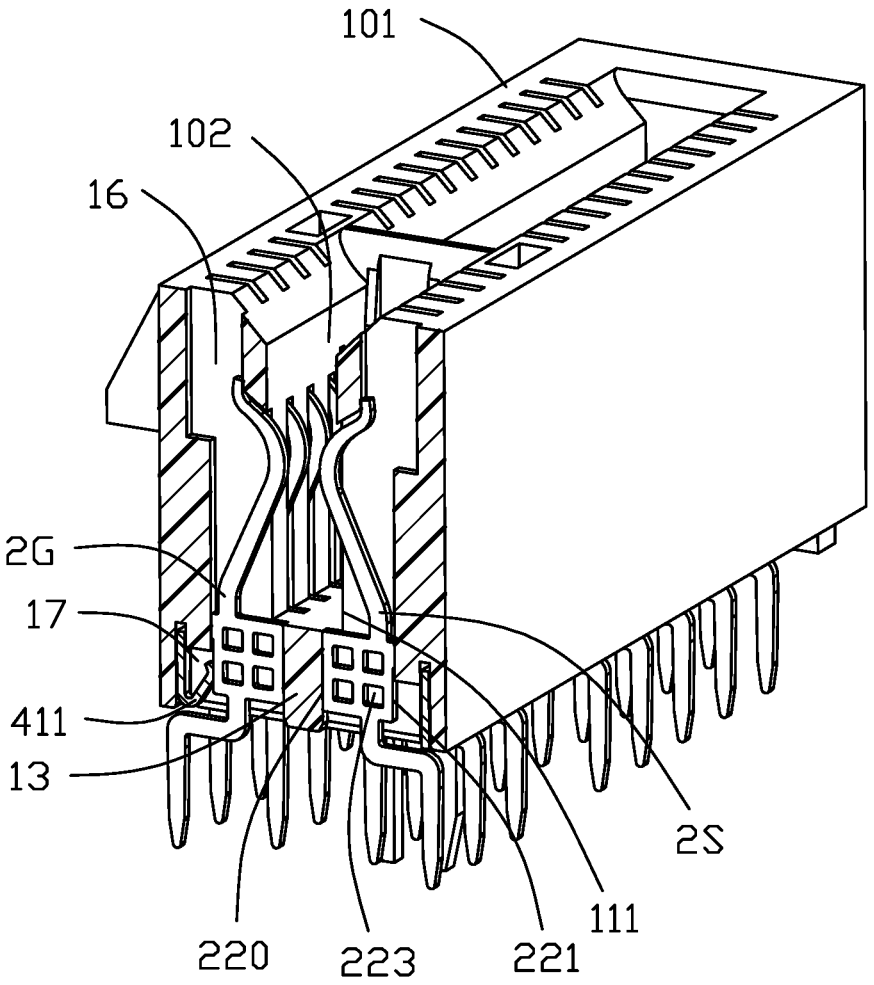
FIG. 3 is a top perspective view of the card edge connector, wherein parts of the connector are cut away.
Figure 4:
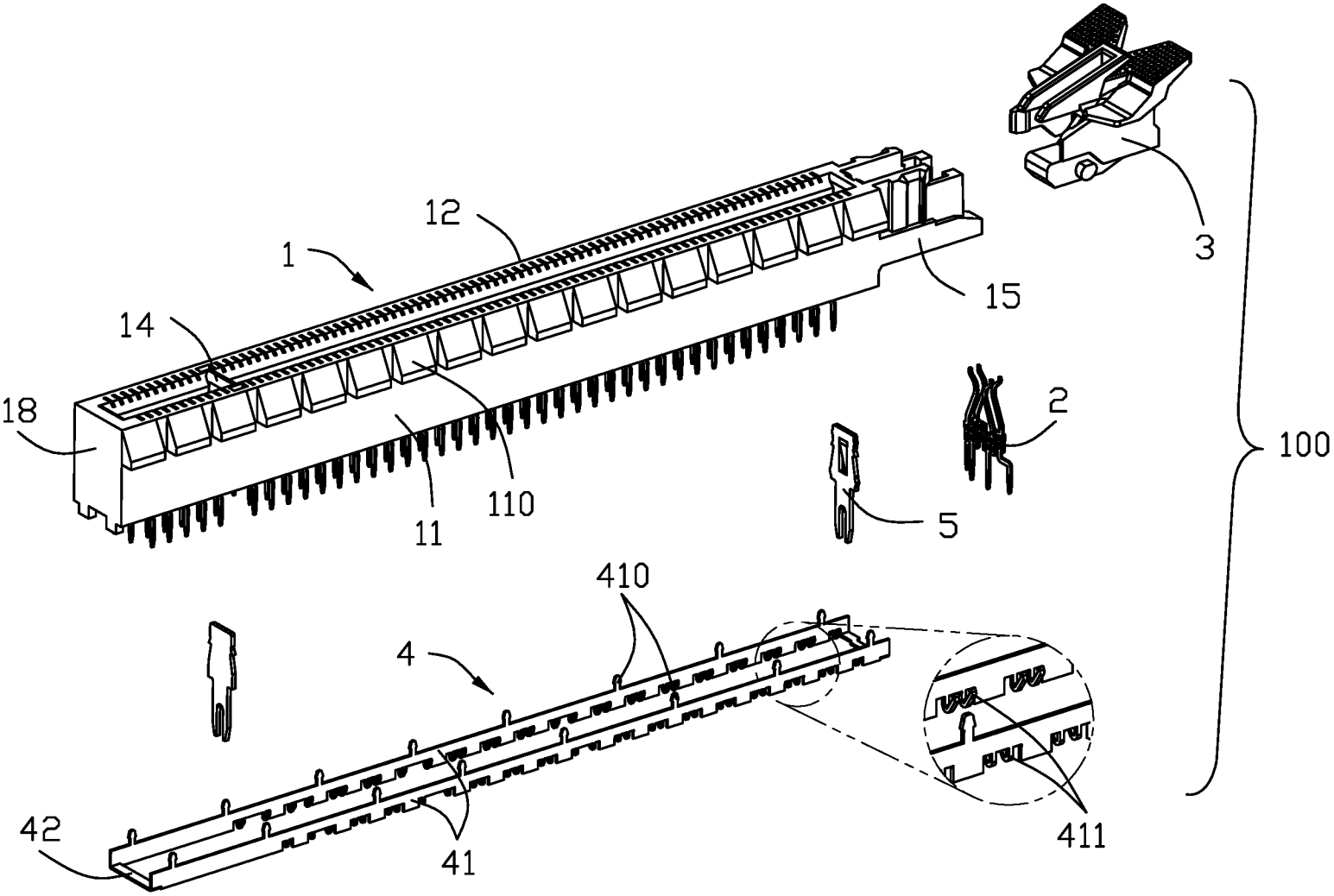
FIG. 4 is an exploded perspective view of the card edge connector of FIG. 1 and a circled partially enlarged portion.

Referring to FIGS. 1-7 illustrating a first embodiment of this invention, this embodiment of this invention is a card edge connector 100, which includes an elongate insulative housing 1, a plurality of contacts 2, a locker 3, a grounding member 4 and a pair of board locks 5.

Figure 7:
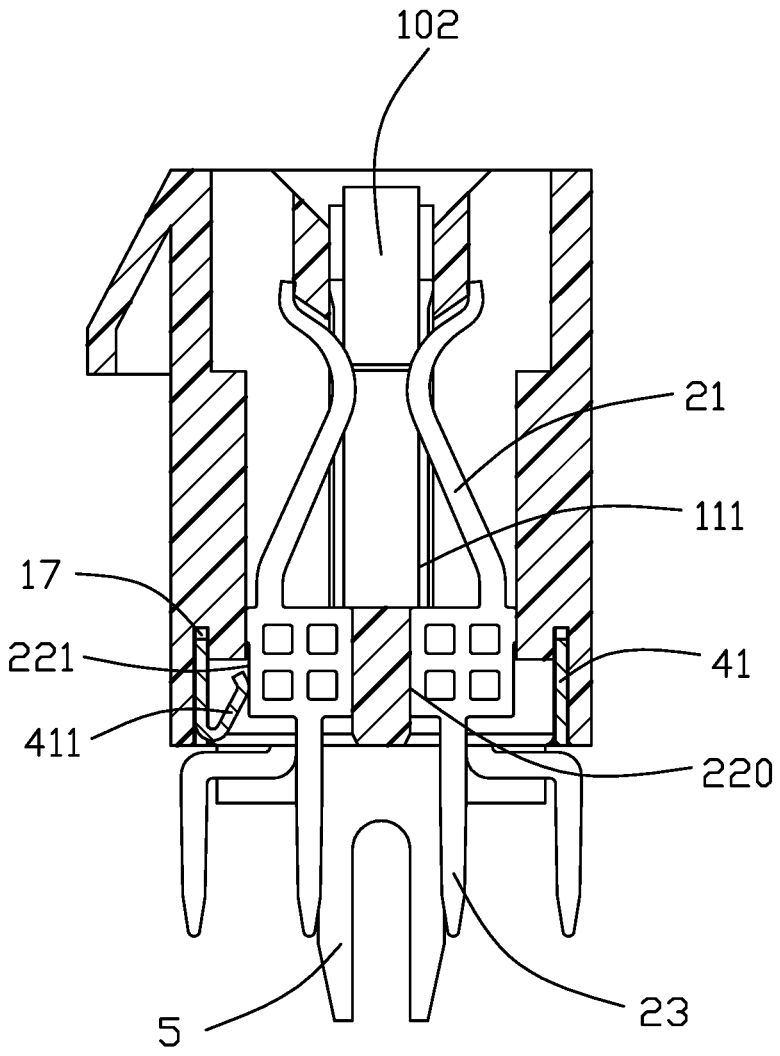
FIG. 7 is a cross-sectional view of the card edge connector according taken along line 7-7 in FIG. 1.
Figure 8:
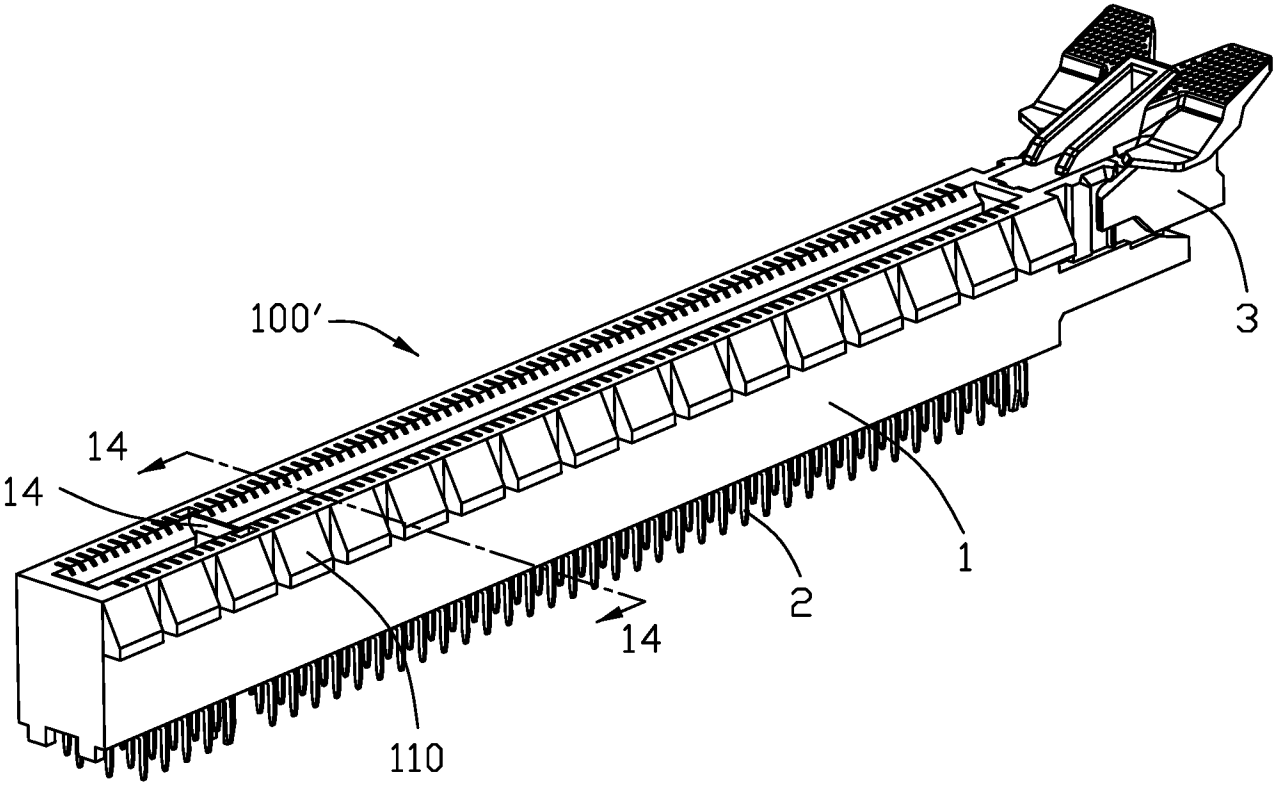
FIG. 8 is a top perspective view of a card edge connector according to a second embodiment of the present invention.
Figure 9:
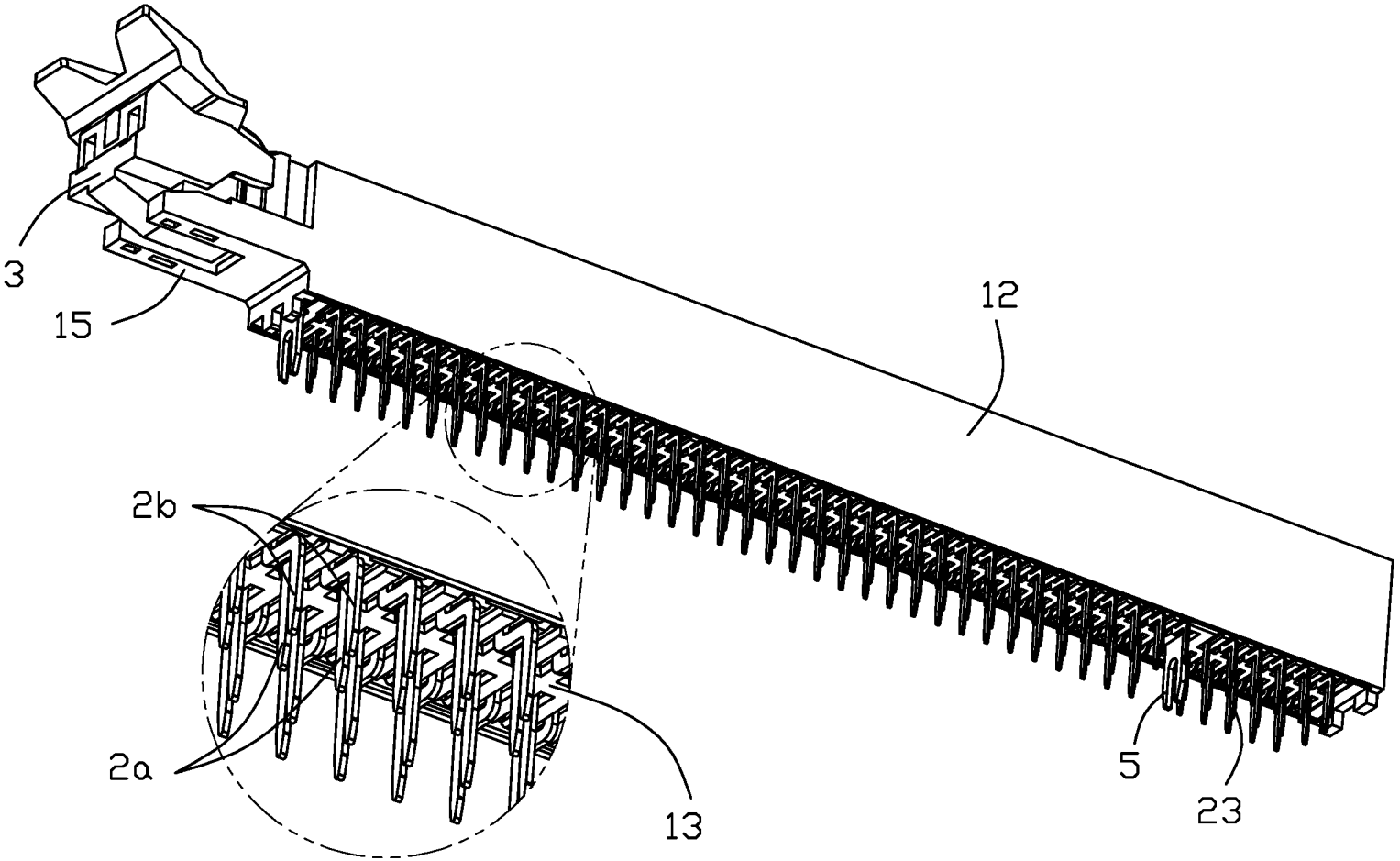
FIG. 9 is a bottom perspective view of the card edge connector of FIG. 8 and a circled partially enlarged portion.
Figure 10:
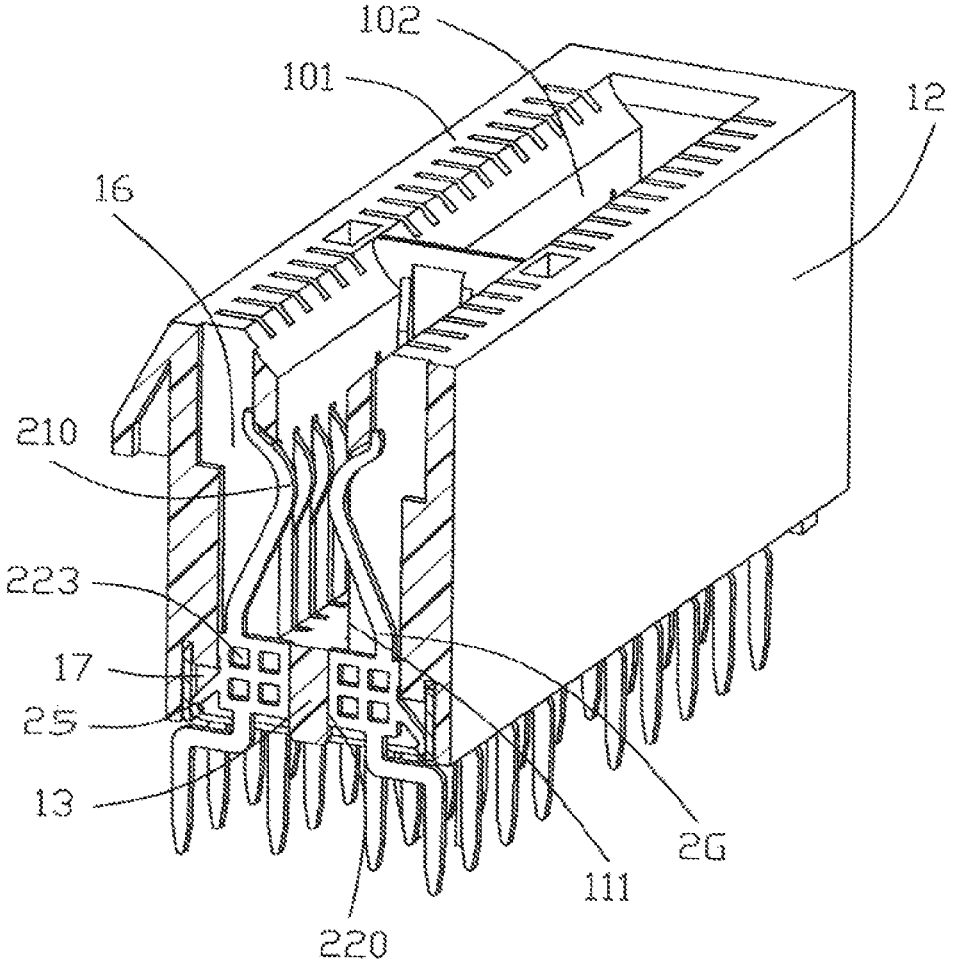
FIG. 10 is a top perspective view of the card edge connector of FIG. 8, wherein parts of the connector are cut away.
Figure 11:
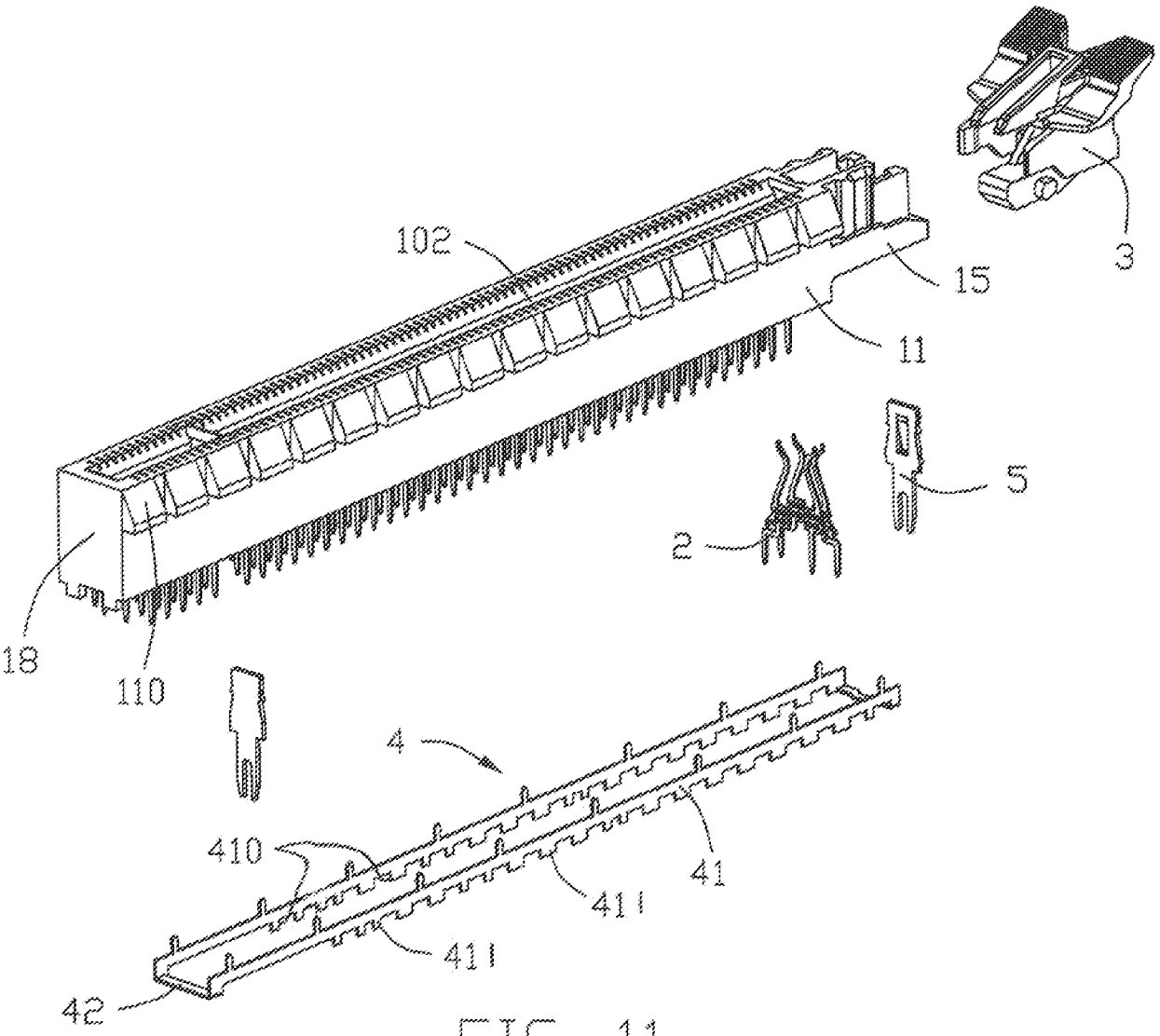
FIG. 11 is an exploded perspective view of the card edge connector of FIG. 8.
Figure 12:
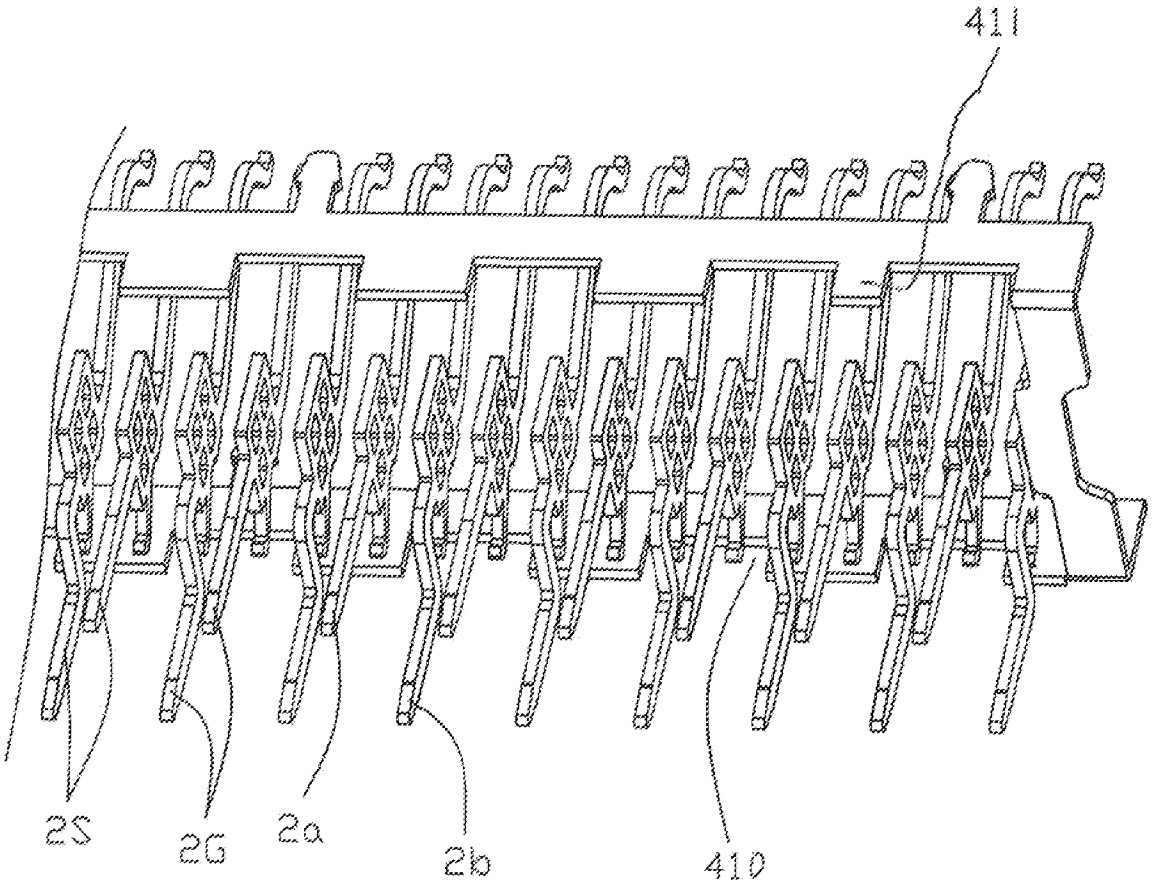
FIG. 12 is a perspective view of parts of the contacts and the ground member.
Figure 13:
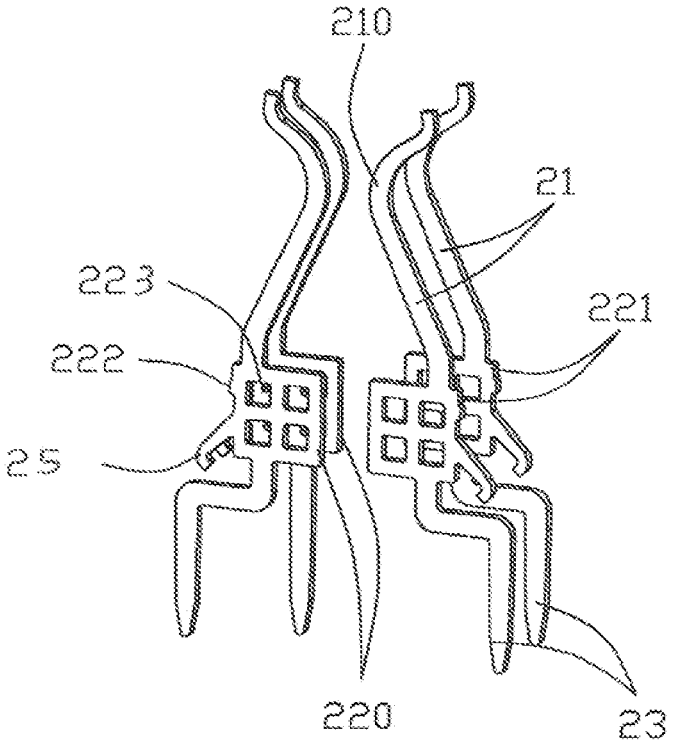
FIG. 13 is a perspective view of two pairs of the contacts.
Figure 14:
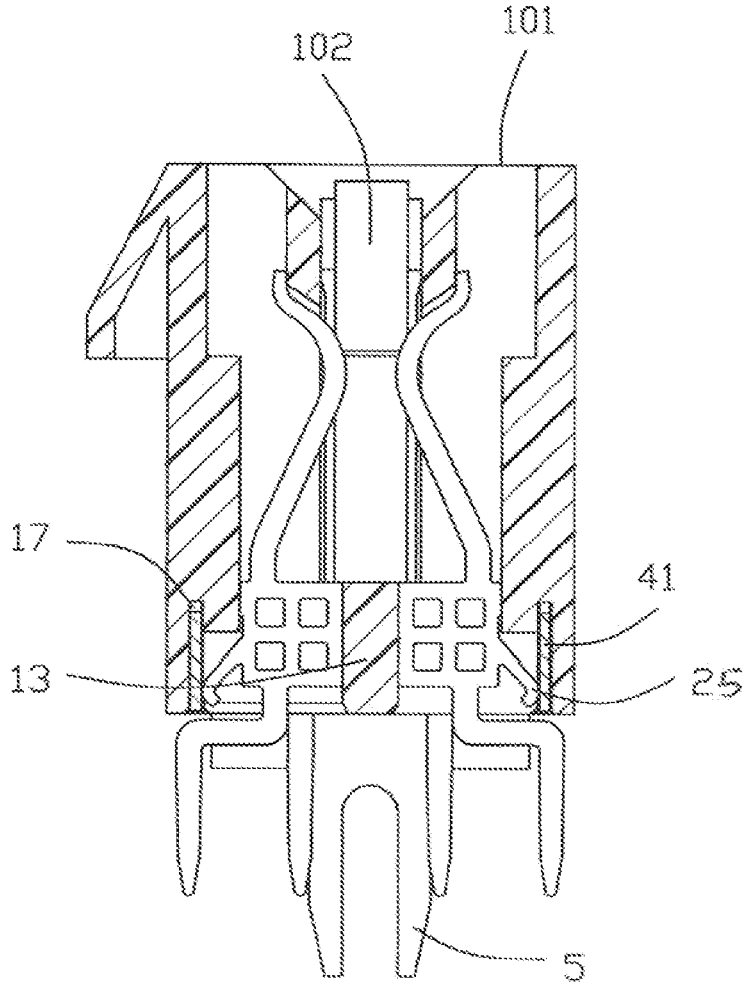
FIG. 14 is a cross-sectional view of the card edge connector taken along line 14-14 in FIG. 8.

Referring to FIGS. 1-4, the longitudinal insulating housing 1 defines a top mating face 101 and includes two opposite long walls 11, 12 or sidewalls defining a card slot 102 between the two long walls 11, 12, and a bottom wall 13 connecting with the long walls in a transverse direction perpendicular to the long walls, and two opposite short walls 18 or end walls, each connecting with longitudinal ends of the long walls. The long walls 11, 12 is longer than the short walls 18 The board locks 5 are retained in the bottom of the short walls 18, respectively. One long wall 11 defines a row of projectors 110 near to the mating face 101, in the transverse direction, which are separated from each other in the longitudinal direction. The other long wall 12 has a plane face. A mounting portion 15 integrally extends outward in the longitudinal direction and offer to contain the locker 3. A key 14 is in the card slot 102 and integrally connecting with the opposite long walls 11, 12. Each long wall defines a row of contact grooves 16 to receive the contacts 2 one by one and a receiving slot 17 running through a bottom face thereof to receive the grounding member 4 as best shown in FIG. 7.

Referring to FIGS. 3-7, the contacts 2 are categorized into two rows in the long walls. Each contact includes a retaining portion 22, a spring portion 21 extending from the retaining portion and a leg portion 23 extending from the retaining portion and out of the insulating housing 1. The spring portion 21 defines a contacting portion 210 arched into the card slot 102 to be contacted with a card inserted in the card slot 102. The contacts 2 are blanking contacts, that is, each contact 2 is punched out a blank from a metal plate, and contacting points are provided on a cutting surface of the blank. The retaining portion 22 defines an outer edge 221 and an inner edge 220 nearer to the card slot 102 than the outer edge 221 in the transverse direction, and two opposite plane surfaces 224 connecting with the outer and inner edges, and an upper edge and a lower edge (not labeled). It's clearly shown that the plane surfaces 224 are larger than each of the edges of the retaining portions 22. The plane surfaces 224 are disposed perpendicular to the longitudinal direction. The outer edges 221 with bars 225 are interfered with the long walls and the inner edges 220 project inward and are interfered with the inside face of the contact grooves 16. It is clearly shown the interfered area of each contact with the insulating housing 1 is increased. The inner edges 220 are located beyond the inner surfaces 111 of the long wall viewed from a top side.

Figure 5:
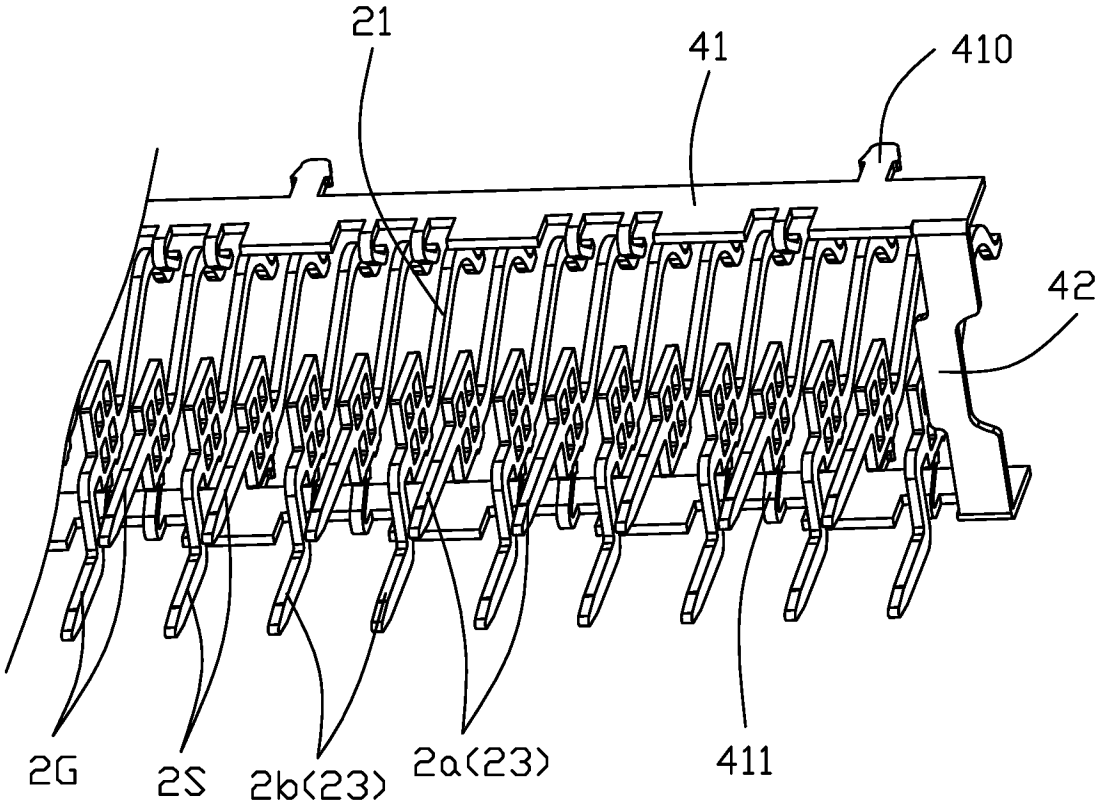
FIG. 5 is a perspective view of a par of the contacts and the ground member.
Figure 6:
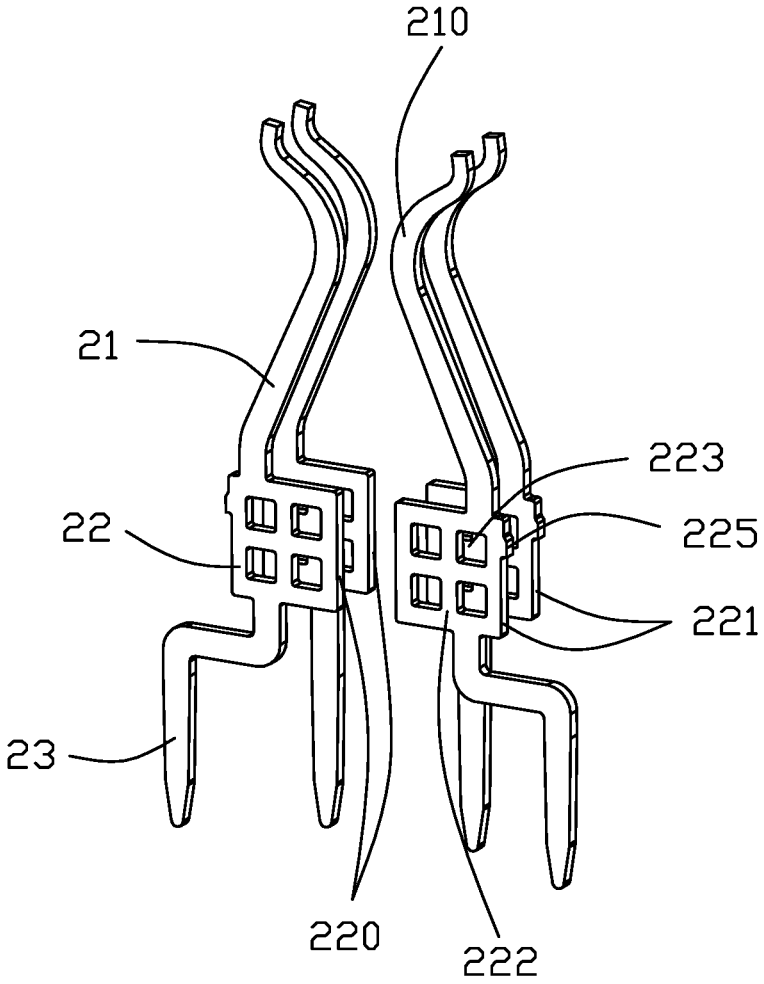
FIG. 6 is a perspective view of two pairs of the contacts.

Referring to FIG. 3-7, the retaining portion 22 defines at least two through holes 223 running through opposite plane surfaces 222 in the longitudinal direction, thereby bringing a little of elasticity of the retaining portion 22. In preferred embodiment, the retaining portion 22 defines two rows of through holes 223. In alternative embodiment, the retaining portion has two through holes arranged in the transverse direction or in the upright direction, Referring to FIG. 5-6, each row of the contacts 2 includes first contacts 2*a* and second contacts 2*b* alternative one by one. The leg portions 23 of the first contacts 2*a* extend downwards straight from a middle point of the bottom edge thereof while leg portion 23 of the second contacts 2*b* extend downward and shift outwards, therefore, the leg portions of the second contacts 2*b* are located at outside of the leg portions of the first contacts 2*a*. The spring portions 21 of the first and second contacts extending from an outer point of the upper edges of the retaining portions 22. As best shown in FIG. 5, the leg portions of the contacts in each long wall are arranged in two rows, the leg portions of the first contacts are located in the inside of the leg portions of the second contacts, while the spring portions 21 and the retaining portions 22 are still in one row. Therefore, the distance between adjacent leg portions 23 increases, making convent of holes defined on printed circuit board where the connector is seated.

Each row of contacts includes a plurality of signal contacts 2S and a plurality of ground contacts 2G. The grounding member 4 retained in the long wall defines contact sections in the form of spring fingers 411 corresponding to the ground contacts 2G. The spring fingers 411 elastically press against the ground contacts 2G, thereby establishing a grounding path of the grounding member 4 and the ground contacts 2G so as to improve high frequency performance. In preferred embodiment, the grounding member includes two long plate 41 and two short plate 42 connecting two ends of the long walls. The grounding member 4 is mounted from the bottom face of the insulating housing and the long plates 41 are received in the receiving slot 17 vertically or parallel to the long walls. The spring fingers 411 extend downward from the bottom edges of the long plate 41 and then slant upwards toward the retaining portion 22. The spring fingers 411 elastically press against the outer edge 211 of the retaining portions. The long plate 41 are distant from and disconnect with the retaining portions 22 of the signal contacts 2S. A plurality of retaining ribs 410 extend upwards from an upper edge of the long plate 41 and retain in the long wall.

Refer to FIGS. 8-14 illustrating a second embodiment of a card edge connector 100' which is similar to the first embodiment of the connector 100 except the engagement of the ground contacts and the grounding member. Hereinafter same elements are labeled with same numbers and only featured structures and elements will be described hereinafter. Each contact further defines a spring finger 25 extending outward from the outer edge 221 towards the grounding member 4. The long plates 41 are vertically retained in the bottom wall 13. The spring fingers 25 of the ground contacts 2G slant downward and press against the long plate 41 of the grounding member 4. The signal contacts 2S have spring fingers as well as the ground contacts, so the long plates 41 define incisions 410 so that the spring fingers of the signal contacts go across the incisions and press against the insulating housing. Consequently, downward extending ribs 411 are formed between every adjacent incisions 410. The slating spring fingers 25 contact the extending ribs 411 so as to increase elasticity. In alternative embodiment, the signal contacts are formed without any spring fingers 25. Two adjacent signal contacts are formed as a pair of differential signal contacts and each pair of differential signal contacts are surrounded with two ground contacts 2G at each side thereof.

Figure 17:
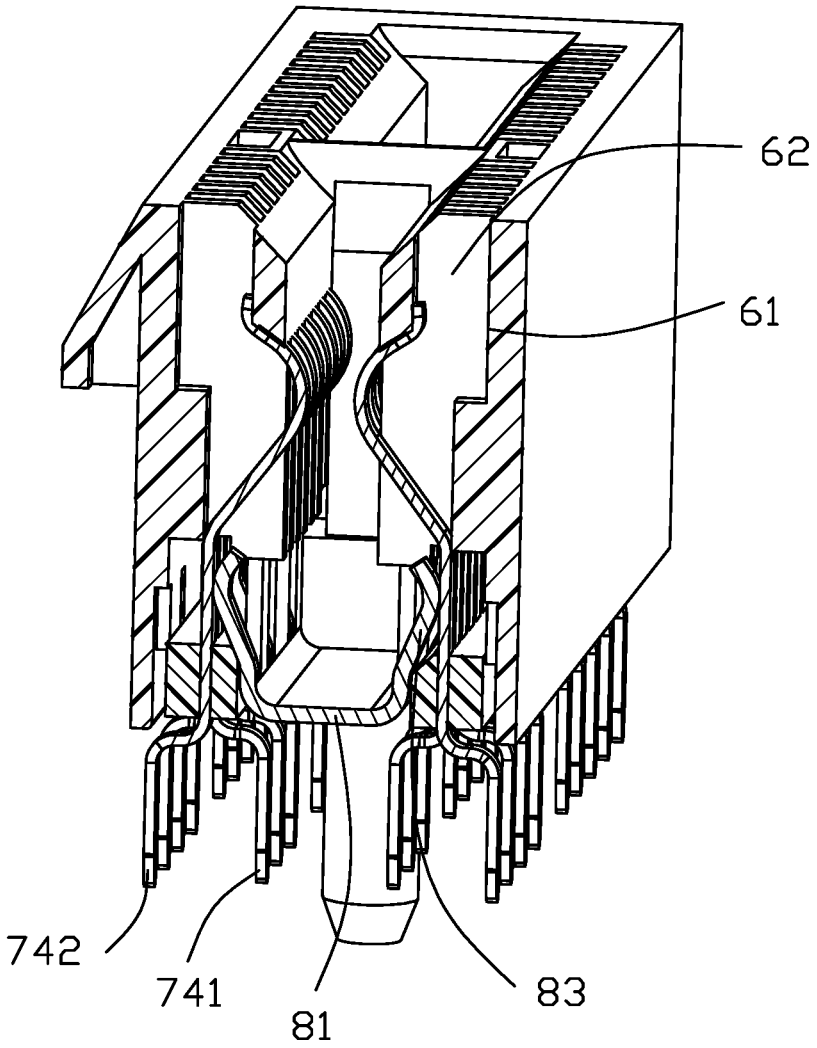
FIG. 17 is a top perspective view of the card edge connector of the third embodiment, wherein parts of the connector are cut away.
Figure 18:
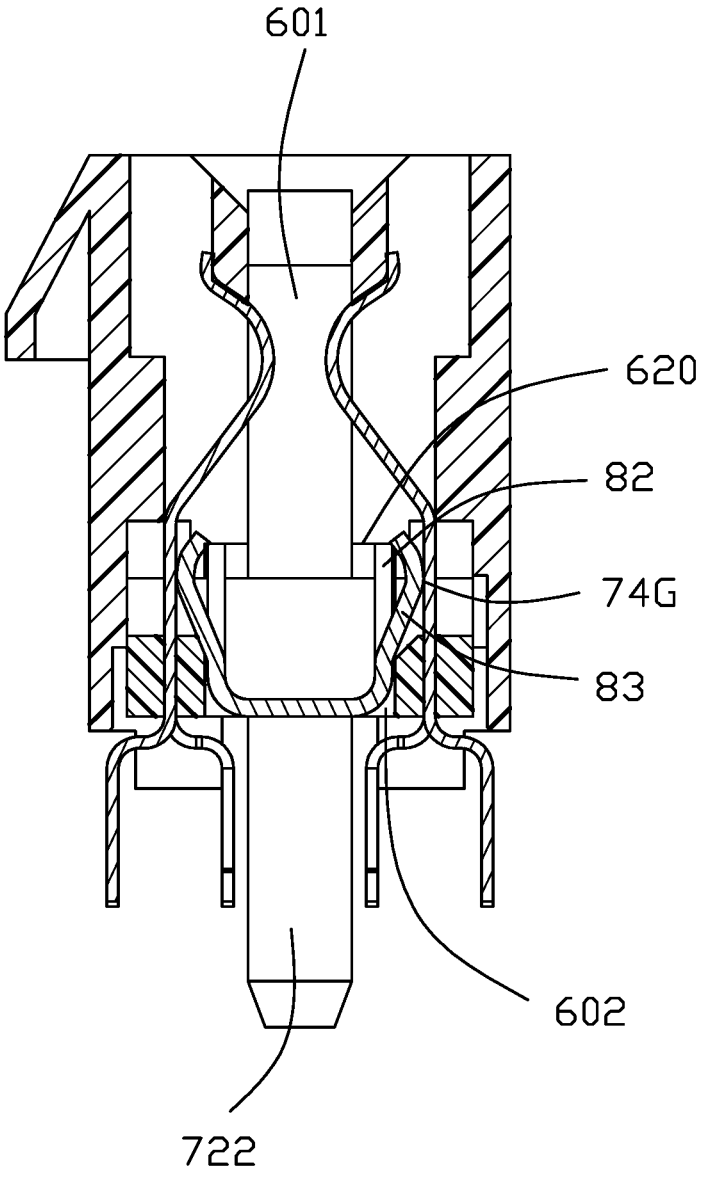
FIG. 18 is a cross sectional view of the card edge connector of the third embodiment.

Referring to FIGS. 15-18 illustrating a third embodiment of this present invention, each contact module includes an insulator 73 and contacts 74 retained in the insulator 73, the contacts 74 include signal contacts 74S and ground contacts 74G, each row of contacts is a pattern of inner leg portion 741 and outer leg portion 742 as best shown in FIG. 17. The two contact modules 71, 72 are assembled into the mounting slot 602 from a bottom face. The mounting slot 602 upwardly communicates with the card slot 601. The second module 72 defines a retaining portion 720 projecting toward the first module 741 with a retaining hole 722 in a hexagon view or other shape in alternative embodiments. A positioning post 721 extend downward from the retaining portion. The first module 71 defines retaining post 710 projecting from the insulator toward the second module. The retaining post 710 is inserted and retained in the retaining hole 722 to assemble the two modules together.

Figure 15:
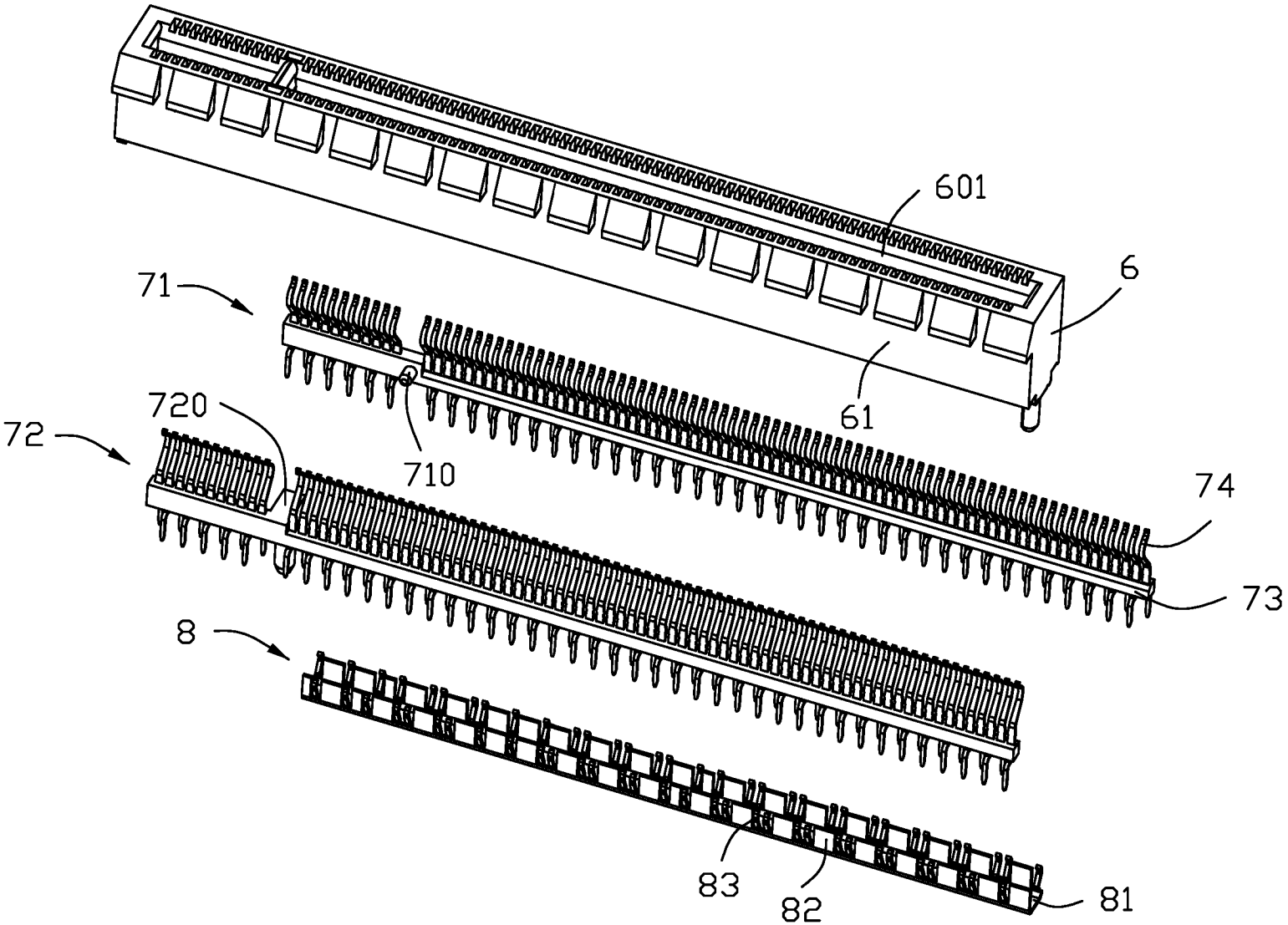
FIG. 15 is a top exploded perspective view of a card edge connector according to a third embodiment of the present invention.
Figure 16:
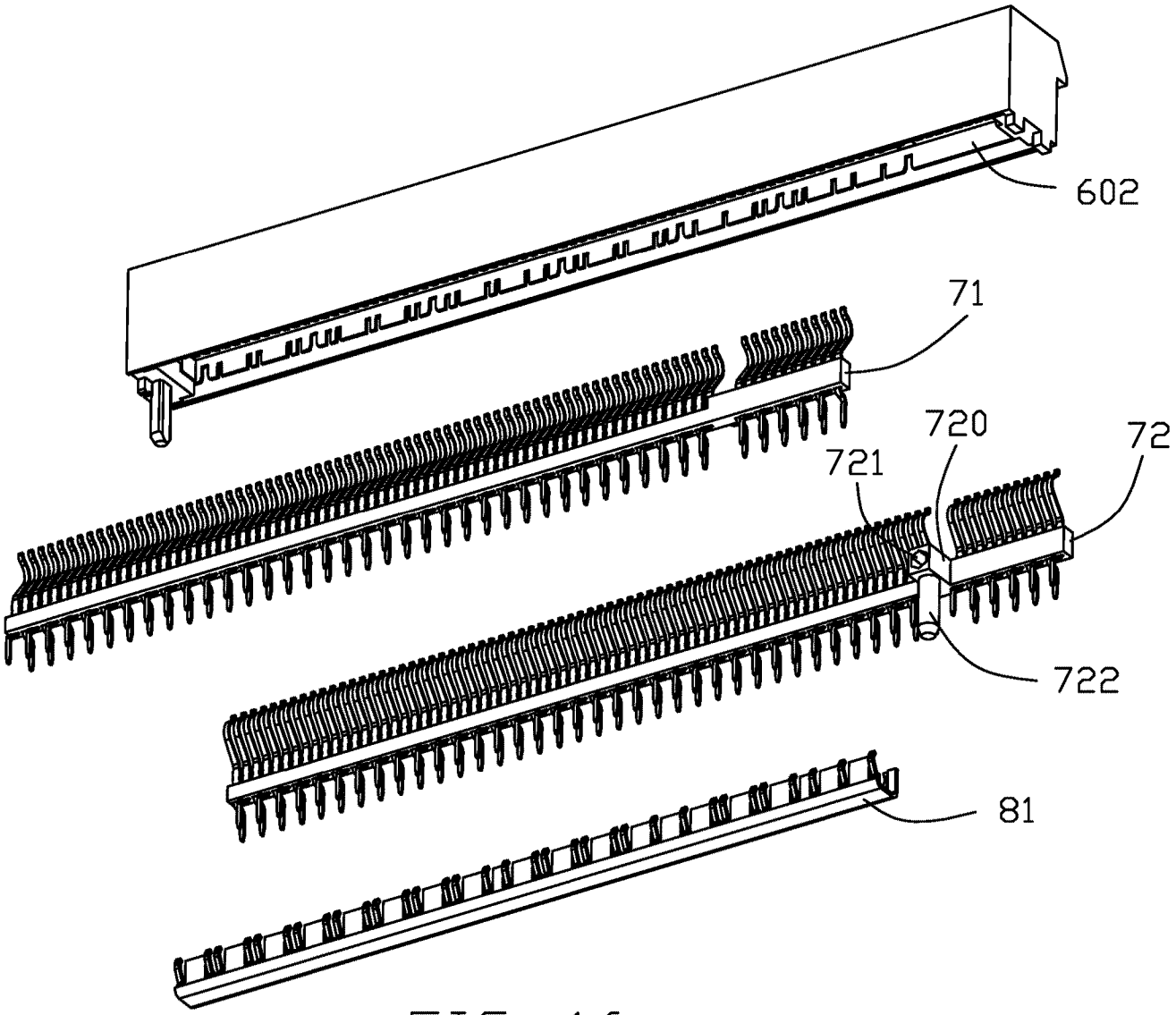
FIG. 16 is a bottom exploded perspective view of the card edge connector of FIG. 15.

Referring to FIGS. 15 and 17, the ground member 8 includes a main plate 81 and two vertical long plates 82 bending from opposite longitudinal edges of the main plate 81. Please notes, the inner leg portions 741 are located under the main plate 81. The ground member 8 includes spring finger 83 which connect with the ground contacts 70G. The spring fingers 83 are punched out from the vertical plate 82. The ground member 8 is sandwiched between the first and second module 71, 72 and the spring fingers press against the ground contacts 2G at the retaining portion to form a sub-assembly. Then the sub-assembly are inserted the mounting slot 602 from a bottom face. The vertical plates 82 are blocked beneath the bottom faces 620 of the partitioning ribs 62 for over up-movement of the ground member 8. The first and second modules 71, 72 are interfered with the inside of the long walls 62. The vertical plate 82 is interfered with the insulator 73.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. A card edge connector comprising:

a longitudinal insulating housing comprising two long walls and a bottom wall connecting with the long walls and defining a card slot in a longitudinal direction among the long walls and the bottom wall, each long wall having a receiving slot at a bottom face thereof;

two rows of contacts arranged in the long walls respectively, each contact comprising a retaining portion, a spring portion extending from the retaining portion, and a leg portion extending from the retaining portion and out of the insulating housing, the spring portions defining contacting portions projecting into the card slot, each row of contacts including signal contacts and ground contacts; and a grounding member retained in the receiving slots of the long walls;

wherein the retaining portion defines an outer edge and an inner edge interfered with the insulating housing and two opposite plane faces connecting with the outer edge and the inner edge and disposed perpendicular to the longitudinal direction, and the grounding member elastically contacts the ground contacts along a transverse direction perpendicular to the longitudinal direction.

2. The card edge connector as claimed in claim 1, wherein each of the retaining portions defines at least one hole through the opposite plane faces.

3. The card edge connector as claimed in claim 1, wherein each of the retaining portions defines at least two holes through the opposite plane faces.

4. The card edge connector as claimed in claim 1, wherein the outer edge of each retaining portion is formed with bars and contacts an associated long wall and the inner edge of each retaining portion is located nearer to the card slot than to an inner face of the associated long wall.

5. The card edge connector as claimed in claim 1, wherein the retaining portion is in a square shape and defines four openings distinct from each other and arranged in two rows in a vertical direction.

6. The card edge connector as claimed in claim 1, wherein the grounding member defines spring fingers elastically contacting the ground contacts.

7. The card edge connector as claimed in claim 6, wherein the grounding member comprises two long plates separate from the signal contacts, the spring fingers bend from a bottom edge of each long plate and slant upward toward the plate outer edges of the ground contacts.

8. The card edge connector as claimed in claim 1, wherein each of the ground contacts defines a spring finger, the spring fingers elastically contacting the grounding member.

9. The card edge connector as claimed in claim 8, wherein a plurality of retaining ribs extent upward from an upper edge of longer plate and interfered with the long wall.

10. The card edge connector as claimed in claim 1, wherein the leg portions of each row of contacts are divided into two rows.

11. The card edge connector as claimed in claim 1, wherein the grounding member is disposed substantially within the receiving slots of the long walls.

12. The card edge connector as claimed in claim 1, wherein the grounding member is constantly in contact with the ground contacts.

13. A card edge connector comprising:

a longitudinal insulating housing comprising two long walls and a bottom wall connecting with the long walls and defining a card slot in a longitudinal direction among the long walls and the bottom wall, each long wall having a receiving slot at a bottom face thereof;

a row of contacts arranged in one of the two long walls and including signal contacts and ground contacts, each contact comprising a retaining portion, a spring portion extending upward from the retaining portion with contacting portions projecting into the card slot, and a leg portion extending downward from the retaining portion; and a grounding member retained in the receiving slot of said one long wall;

wherein each of the retaining portions define an outer edge and inner edge both interfered with the insulating housing and two opposite plane faces connecting with the outer and inner edge and disposed perpendicular to the longitudinal direction, the inner edges of retaining portions are aligned with the contacting portions from a top view, and the grounding member elastically contacts the ground contacts along a transverse direction perpendicular to the longitudinal direction.

14. The card edge connector as claimed in claim 13, wherein each of the retaining portions defines at least one hole through the opposite plane faces.

15. The card edge connector as claimed in claim 13, wherein one of the ground member and the ground contacts comprises spring fingers elastically contact another of the ground member and the ground contacts.

16. The card edge connector as claimed in claim 15, wherein the spring fingers extend from the outer edges of the retaining portions of the ground contacts to contact the grounding member.

17. The card edge connector as claimed in claim 16, wherein the signal contacts define spring fingers extending from the outer edges of the retaining portions thereof but spaced from the grounding member.

18. The card edge connector as claimed in claim 13, wherein the grounding member is disposed substantially within the receiving slot of the long wall.

19. The card edge connector as claimed in claim 13, wherein the grounding member is constantly in contact with the ground contacts.

* * * * *